US009439254B2

(12) United States Patent
Shin

(10) Patent No.: US 9,439,254 B2
(45) Date of Patent: Sep. 6, 2016

(54) AC-DIRECT DRIVE-TYPE LED DRIVING DEVICE

(71) Applicant: Bong Sup Shin, Anyang-si (KR)

(72) Inventor: Bong Sup Shin, Anyang-si (KR)

( * ) Notice: Subject to any disclaimer, the term of this patent is extended or adjusted under 35 U.S.C. 154(b) by 0 days.

(21) Appl. No.: 14/435,631

(22) PCT Filed: Aug. 13, 2013

(86) PCT No.: PCT/KR2013/007281
§ 371 (c)(1),
(2) Date: Apr. 14, 2015

(87) PCT Pub. No.: WO2015/023011
PCT Pub. Date: Feb. 19, 2015

(65) Prior Publication Data

US 2015/0237697 A1 Aug. 20, 2015

(51) Int. Cl.
*H05B 37/02* (2006.01)
*H05B 33/08* (2006.01)

(52) U.S. Cl.
CPC ..... *H05B 33/0824* (2013.01); *H05B 33/0848* (2013.01); *H05B 37/02* (2013.01)

(58) Field of Classification Search
CPC ..... H05B 33/0824; H05B 33/0848; H05B 37/02
USPC ..... 315/122, 192, 193, 291, 294, 307, 308
See application file for complete search history.

(56) References Cited

U.S. PATENT DOCUMENTS

| | | | | |
|---|---|---|---|---|
| 8,901,849 | B2 * | 12/2014 | Jeong | H05B 33/083 315/122 |
| 9,066,392 | B2 * | 6/2015 | Lee | H05B 33/0809 |
| 9,144,128 | B2 * | 9/2015 | Shin | H05B 33/083 |
| 2010/0194298 | A1 * | 8/2010 | Kuwabara | H05B 33/083 315/186 |
| 2012/0081009 | A1 * | 4/2012 | Shteynberg et al. | 315/122 |
| 2013/0307423 | A1 | 11/2013 | Lee | |

FOREIGN PATENT DOCUMENTS

| | | | |
|---|---|---|---|
| JP | 2007-200828 | A | 8/2007 |
| JP | 2012-186183 | A | 9/2012 |
| KR | 10-2012-0067918 | A1 | 6/2012 |
| KR | 10-2013-0085843 | A | 7/2013 |
| WO | WO 2012-003119 | A1 | 1/2012 |

* cited by examiner

*Primary Examiner* — Tung X Le
(74) *Attorney, Agent, or Firm* — Rabin & Berdo, P.C.

(57) ABSTRACT

The present invention relates to a device for driving LEDs and, more specifically, to an AC-direct drive-type LED driving device, capable of sequentially driving LEDs connected in series in reverse order by starting with an LED located at the end until a certain size of power is supplied, and sequentially driving the LEDs connected in series in order if the certain size of power is supplied, rather than measuring the size of a rectified power and sequentially driving the LEDs connected in series based on the measured size of the power; thereby equalizing the power consumption of all the LEDs connected in series to thereby equalize the life span of the LEDs regardless of the serial connection order of the LEDs and unifying the brightness of all the LEDs connected in series.

17 Claims, 9 Drawing Sheets

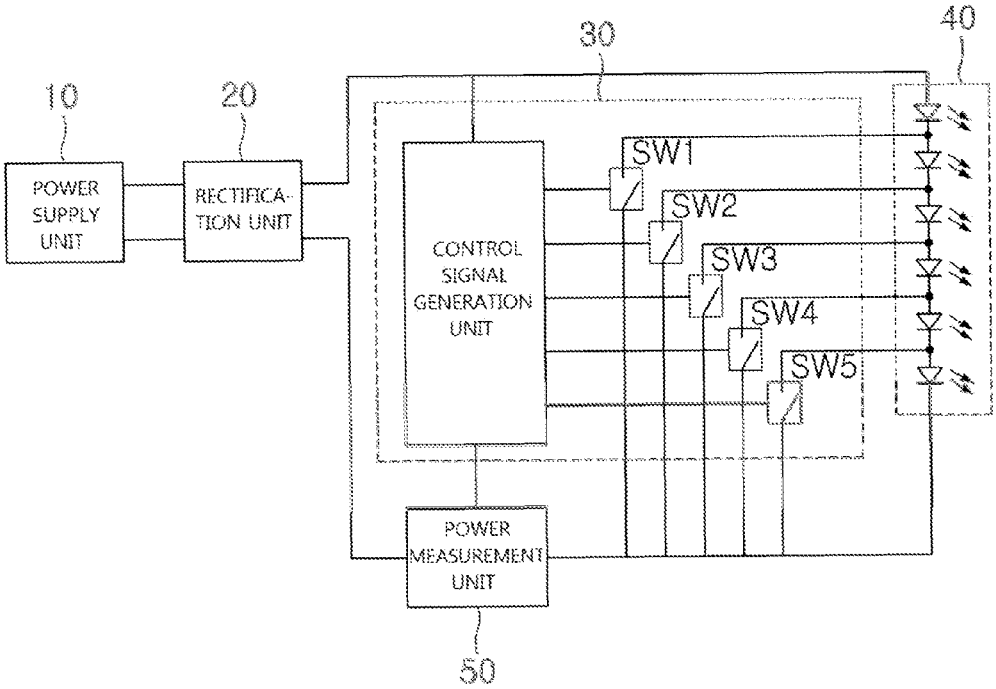
FIG. 1 PRIOR ART
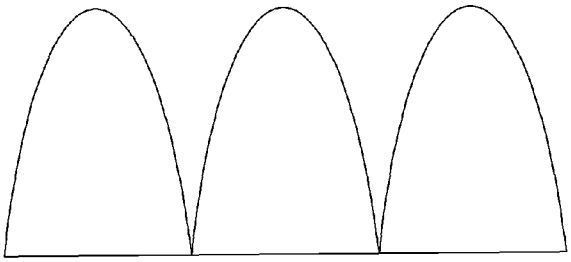
FIG. 2 PRIOR ART

AC-DIRECT DRIVE-TYPE LED DRIVING DEVICE

TECHNICAL FIELD

The present invention relates to a light-emitting diode (LED) driving device, and more particularly, to an AC-direct drive-type LED driving device in which LEDs connected in series are driven sequentially in reverse order, by starting from the last LED before a predetermined magnitude of power is applied, and LEDs connected in series are driven sequentially in order when the predetermined magnitude of power is applied, rather than measuring the magnitude of rectified power and sequentially driving the LEDs connected in series based on the measured magnitude of the power, so that the power consumption of all the LEDs connected in series is equalized and thus the lifespans of the LEDs and the brightnesses of all the LEDs connected in series can be equalized regardless of the serial connection order of the LEDs.

BACKGROUND ART

In recent years, a lighting device using a light-emitting diode (LED) that is semi-permanent in lifespan and is very low in power consumption has been introduced in various manners. LEDs are more stable and reliable that other thermal conversion light-emitting elements. In addition, LEDs are low in power consumption and is long in lifespan. Currently, an LED technology is developing by leaps and bounds, and high-efficiency, high-brightness LEDs having a variety of colors are being released on the market. A single LED acts as a point light source, but a plurality of LEDs collected together forms a linear light or a surface light source so that they can be utilized as a lighting device.

A lighting using LEDs is, first of all, excellent in energy-saving effect due to low power consumption. In addition, the lighting using LEDs has an effect of reducing the environmental pollution by substituting for a conventional electric lamp including variety of hazardous substances and having a short lifespan.

The LED lighting includes an LED unit consisting of a plurality of LEDs connected in series. The driving of the LED unit requires that the LED unit should be applied with a voltage greater than the sum of the forward operating voltages of the series connected LEDs. A typical LED driving device rectifies commercial AC power into DC power and converts the rectified DC power into a predetermined magnitude of DC power through a switch mode power supply (hereinafter, referred to as "SMPS") for application to the LED unit. However, the SMPS generates the predetermined magnitude of DC power through a high-speed switching operation to cause much noise, thus leading to interference, which adversely affects the surrounding circuit elements. In order to compensate for this adverse effect, an LED driving device employing the SMPS entails a problem in that other circuit components including a noise filter and the like must be additionally provided, thus leading to an increase in volume and weight and thus increasing the manufacturing cost.

In an effort to solve the problem involved in the conventional LED driving device employing the SMPS, an AC-direct drive type LED driving device has been developed and used. The AC-direct drive type refers to a method of driving the LEDs by directly applying the rectified DC power to the LED unit, instead of rectifying commercial AC power into DC power and converting the rectified DC power into a predetermined magnitude of DC power through an SMPS for application to the LED unit.

FIG. 1 is a block diagram illustrating one example of a conventional AC-direct drive type LED driving device in accordance with the prior art.

Referring to FIG. 1, a power supply unit 10 supplies commercial AC power, and a rectification unit 20 rectifies the commercial AC power applied thereto from the power supply unit 10 into DC power. Herein, the rectification unit 20 may use various rectifier circuits that rectify AC power into DC power, including a bridge diode rectifier circuit, which falls within the scope of the present invention. The DC power rectified by the rectification unit 20 has a magnitude of 0 V at 0°, a magnitude of 70.7% of the maximum power magnitude at 45°, and the maximum power magnitude of 100% at 90°, respectively.

The rectification unit 20 applies the rectified DC power to an LED unit 40 in which five LEDs are connected in series. A power measurement unit 50 measures the magnitude of the DC power applied to the LED unit 40. In this case, the LED unit 40 may be configured such that a different number of LEDs are connected in series.

A light emission control unit 30 controls the operation of the LEDs such that a maximum number of LEDs connected in series are driven depending on the magnitude of the power applied to the LED unit 40 based on the magnitude of the DC power measured by the power measurement unit 50. More specifically, the operation of the light emission control unit 30 will be described hereinafter. A control signal generation unit 31 controls the operation of switches SW1 to SW5 based on the measured magnitude of the DC power and the operating voltage $V_f$ of the respective LEDs constituting the LED unit 40. In other words, if the measured magnitude V of the DC power is smaller than or equal to $2V_f$ (i.e., $V \leq 2V_f$), the control signal generation unit 31 controls a first switch SW1 to be turned on and the remaining switches SW2, SW3, SW4 and SW5 to be turned off so that only a first LED of the LED unit 40 is controlled to be driven. If the measured magnitude V of the DC power increases gradually and then is larger than or equal to $2V_f$ and $3V_f$ (i.e., $2V_f \leq V \geq 3V_f$), the control signal generation unit 31 controls a second switch SW2 to be turned on and the remaining switches SW1, SW3, SW4 and SW5 to be turned off so that the first LED and the next LED of the LED unit 40 are controlled to be driven sequentially in order. If the measured magnitude V of the DC power is larger than or equal to $5V_f$ (i.e., $V \geq 5V_f$) in the same manner as in the above case, the control signal generation unit 31 controls all the switches SW1 to SW5 to be turned off so that all the LEDs constituting the LED unit 40 are controlled to be driven sequentially in the serial connection order (L1→L2→L3→L4→L5→L6) thereof.

DISCLOSURE OF INVENTION

Technical Problem

In the case of the conventional AC-direct drive type LED driving device as described above with reference to FIG. 1, LEDs connected in series are controlled to be driven sequentially in order depending on the magnitude of the power applied to the LED unit based on the magnitude of the power applied to the LED unit. Thus, the first LED of a plurality of LEDs connected in series is controlled to be driven nearly irrespective of a change in the magnitude of the power applied to the LED unit whereas the last LED of the LED unit is controlled to be driven only when the maximum voltage is applied to the LED unit. Thus, the conventional AC-direct drive type LED driving device involves a problem in that the average power consumptions of the plural LEDs constituting the LED unit 40 are made different from each other, thus resulting in a difference in the average lifespans of the LEDs plural LEDs constituting the LED unit 40. Furthermore, the conventional AC-direct drive type LED driving device encounters a problem in that the brightnesses of the LEDs connected in series in the LED unit 40 are made different from each other depending on the connection positions of the LEDs, and thus the LED unit is not suitable for use as a lighting.

Accordingly, the present invention has been made to solve the above-mentioned problems occurring in the conventional prior art, and it is an object of the present invention to provide an LED driving device in which LEDs connected in series are driven sequentially in reverse order, by starting from the last LED before a predetermined magnitude of power is applied, and LEDs connected in series are again driven sequentially in order when the predetermined magnitude of power is applied, based on the measured magnitude of the power, so that the lifespans of the LEDs can be equalized.

Another object of the present invention is to provide an LED driving device in which the driving order of LEDs is changed depending on the magnitude of power applied to the LEDs in an LED lighting with a plurality of LEDs connected in series so that the brightnesses of all the LEDs are equalized.

Still another object of the present invention is to provide an AC-direct drive type LED driving device in which flickering can be prevented by a multi-stage reduction circuit.

Technical Solution

To achieve the above object, in accordance with an embodiment of the present invention, there is provided an LED driving device including: a power supply unit for rectifying AC power and supplying the rectified power; an LED unit for emitting light using the power supplied thereto from the power supply unit, the LED unit including a first LED group and a second LED group, each LED group including one or more LEDs connected in series with each other; a power measurement unit for measuring the magnitude of the power supplied from the power supply unit to the LED unit; and a light emission control unit for controlling the light-emitting order of the LEDs of the LED unit so that the LEDs of the second LED group emit light sequentially in reverse order or the first LED group and the second LED group emit light sequentially in order based on the measured magnitude of the power, wherein the first LED group and the second LED group are connected in series with each other.

The light emission control unit may controls the LEDs of the second LED group to emit light sequentially in reverse order, by starting from the last LED of the second LED group if the measured magnitude of the power is smaller than or equal to a first threshold magnitude, and control the LEDs of the first LED group and the second LED group to emit light sequentially in order, by starting from the first LED of the first LED group if the measured magnitude of the power is larger than or equal to the first threshold magnitude.

Herein, the first threshold magnitude may be a sum of the magnitudes of the driving power of the LEDs constituting the first LED group.

The number (n) of LEDs constituting the second LED group may be represented by the following equation 1:

$$n \le \left(\frac{t}{2}\right)_i \qquad \text{[Equation 1]}$$

wherein t is the number of a total of LEDs of the first LED group and the second LED group, and (t/2)i is a round down integer of t/2.

The light emission control unit 130 may include: a comparison unit for comparing the measured magnitude of the power with the first threshold magnitude; a first supply control unit for primarily selecting the LEDs whose light emission is to be controlled from the second LED group in reverse order based on the magnitude of the driving power of the LEDs constituting the second LED group and the measured magnitude of the power if the measured magnitude of the power is smaller than or equal to the first threshold magnitude based on the comparison result of the comparison unit, and controlling the supply of the power to the primarily selected LEDs of the second LED group; and a second supply control unit for secondarily selecting the LEDs whose light emission is to be controlled from the second LED group in order based on a difference between the measured magnitude of the power and a sum of the magnitudes of the LED driving power of the first LED group and the magnitude of the driving power of LEDs constituting the second LED group if the measured magnitude of the power is larger than or equal to the first threshold magnitude based on the comparison result of the comparison unit 131, and controlling the supply of the power to the LEDs of the first LED group and the primarily selected LEDs of the second LED group.

The LED driving device may further include a reduction unit connected in parallel with the rectification unit and the LED unit so as to charge the power applied from the power supply unit to the LED unit, and maintain the magnitude of the power supplied from the power supply unit to the LED unit if the magnitude of the power supplied from the power supply unit to the LED unit is smaller than the magnitude of the power charged in the reduction unit.

Preferably, the reduction unit may include a plurality of unit reduction units DU that are connected in series with each other, and wherein the unit reduction unit comprises a condenser for charging the power supplied from the power supply unit to the LED unit.

Preferably, the power measurement unit may measures the magnitude of current or voltage supplied to the LED unit, and determine the magnitude of power supplied to the LED unit based on the measured current or voltage.

Preferably, the power measurement unit may measure the phase of the power supplied to the LED unit 140, and determine the magnitude of power supplied to the LED unit 140 based on the measured phase.

Advantageous Effects

The AC-direct drive type LED driving device according to the embodiment of the present invention as constructed above have the following various advantageous effects over the conventional AC-direct drive type LED driving device.

First, the LED driving device in accordance with the present invention enables the LEDs connected in series to be driven sequentially in reverse order, by starting from the last LED of the LEDs constituting an LED unit or are driven sequentially in order, by starting from the first LED of the LEDs depending on the magnitude of the measured power so that the liftspans of the LEDs constituting the LED unit can be equalized.

Second, the LED driving device in accordance with the present invention anables the LEDs connected in series to be driven sequentially in reverse order, by starting from the last LED of the LEDs constituting an LED unit or are driven sequentially in order, by starting from the first LED of the LEDs depending on the magnitude of the measured power so that the brightnesses of all the LEDs can be equalized in an LED light with a plurality of LEDs are connected in series.

Third, the LED driving device in accordance with the present invention enables the power applied from the rectification unit to the LED unit to be charged by the reduction circuit so that the magnitude of the power applied from the rectification unit is low, and thus the LEDs are not turned off temporarily, thereby preventing flickering from occurring. Moreover, in the LED driving device in accordance with the present invention, a plurality of unit reduction circuits connected in series is configured in a multiple stage manner so that a charged power can be stepwisely supplied to the LED unit and the reduction can be configured of low-capacity capacitors.

BRIEF DESCRIPTION OF THE DRAWINGS

The above and other objects, features and advantages of the present invention will be apparent from the following detailed description of the preferred embodiments of the invention in conjunction with the accompanying drawings, in which:

FIG. 1 is a block diagram illustrating one example of a conventional AC-direct drive type LED driving device in accordance with the prior art.

FIG. 2 is a waveform diagram illustrating a waveform of power rectified by a rectification unit in FIG. 1;

BEST MODE FOR CARRYING OUT THE INVENTION

Hereinafter, an LED driving device in accordance with an embodiment of the present invention will be described in more detail with reference to the accompanying drawings.

Figure 3:
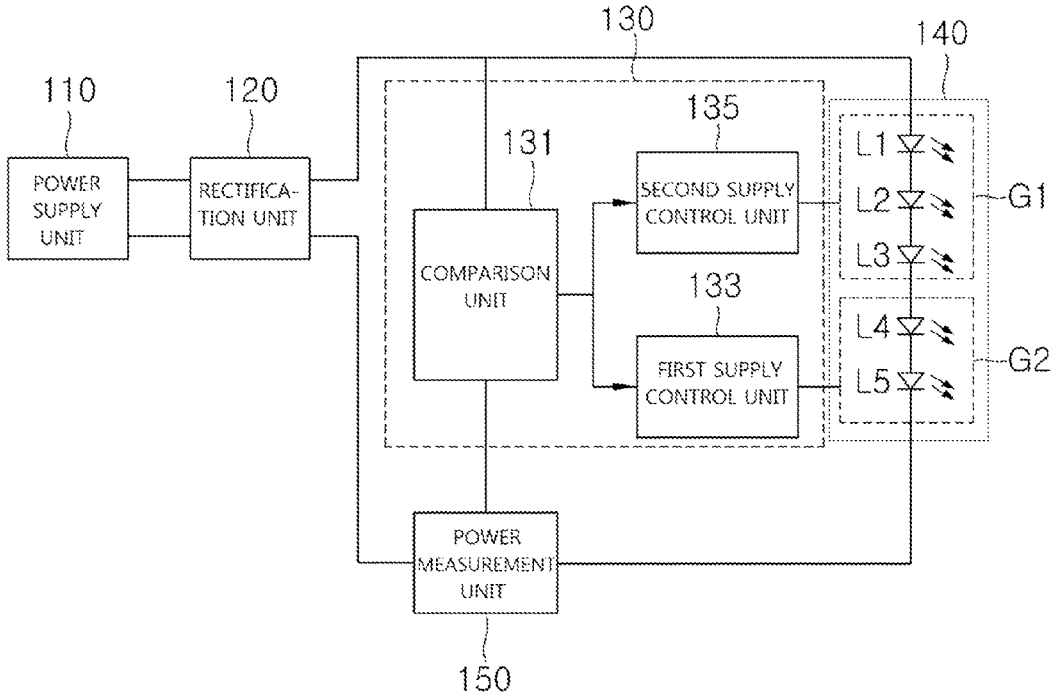
FIG. 3 is a block diagram illustrating an LED driving device in accordance with an embodiment of the present invention.

FIG. 3 is a block diagram illustrating an LED driving device in accordance with an embodiment of the present invention Referring to FIG. 3, more specifically, a power supply unit 110 supplies commercial AC power, and a rectification unit 120 rectifies the commercial AC power applied thereto from the power supply unit 110 into DC power. Herein, the rectification unit 20 may use various rectifier circuits that rectify AC power into DC power having a sine wave whose magnitude is changed over time, including a bridge diode rectifier circuit, which falls within the scope of the present invention. For example, when the commercial AC power is applied to the rectification unit 20 from the power supply unit 110, the DC power rectified by the rectification unit 20 has a magnitude of 0 V at 0°, a magnitude of 70.7% of the maximum power magnitude at 45°, and the maximum power magnitude of 100% at 90°, respectively. Subsequently, the rectified DC power has a magnitude of 70.7% of the maximum power magnitude at 135° and a magnitude of 0 V at 180°. In this manner, a sine wave having the above magnitude at each angle is repeated.

A rectification unit 120 applies the rectified DC power to an LED unit 140 in which five LEDs are connected in series. The LED unit 140 includes a first LED group G1 in which one or more LEDs are connected in series with each other and a second LED group G1 in which one or more LEDs are connected in series with each other. The first LED group G1 and the second LED group G2 are connected in series with each other. The LED unit 140 emits light using the power supplied thereto from the rectification unit 120. The LED unit 140 may be configured such that a different number of LEDs are connected in series depending on a technical field to which the present invention is applied.

The power measurement unit 150 measures the magnitude of the power supplied from the rectification unit 120 to the LED unit 140. The light emission control unit 130 controls the light-emitting order of the LEDs of the LED unit 140 so that the LEDs of the second LED group G2 emit light sequentially in reverse order, by starting from the last LED of the second LED group G2, or the LEDs of the first LED group G1 and the second LED group G2 emit light sequentially in order, by starting from the first LED of the first LED group G1, based on the measured magnitude of the power.

The light emission control unit in accordance with the present invention controls the LEDs of the second LED group G2 to emit light sequentially in reverse order, by starting from the last LED of the second LED group G2 if the measured magnitude of the power is smaller than or equal to a first threshold magnitude, and controls the LEDs of the first LED group G1 and the second LED group G2 to emit light sequentially in order, by starting from the first LED of the first LED group G1 if the measured magnitude of the power is larger than or equal to the first threshold magnitude.

The power measurement unit 150 in accordance with one example of the present invention can measure the magnitude of current or voltage supplied to the LED unit 140, and determine the magnitude of power supplied to the LED unit 140 based on the measured current or voltage. Meanwhile, the power measurement unit 150 in accordance with another example of the present invention can measure the phase of the power supplied to the LED unit 140, and determine the magnitude of power supplied to the LED unit 140 based on the measured phase. More specifically, the light emission control unit 130 in accordance with the present invention includes a comparison unit 131, a first supply control unit 133, and a second supply control unit 135.

The comparison unit 131 compares the measured magnitude of the power with the first threshold magnitude and outputs a comparison result value. The first supply control unit 133 and the second supply control unit 135 controls the LEDs of the second LED group G2 to be driven sequentially in reverse order or controls the LEDs of the first LED group G1 and the second LED group G2 based on the comparison result signal.

First, the first supply control unit 133 primarily selects the LEDs whose light emission is to be controlled from the second LED group G2 in reverse order based on the magnitude of the driving power of the LEDs constituting the second LED group G2 and the measured magnitude of the power if the measured magnitude of the power is smaller than or equal to the first threshold magnitude based on the comparison result of the comparison unit 131, and controls the supply of the power to the primarily selected LEDs of the second LED group G2. In other words, the first supply control unit 133 controls a maximum number of LEDs connected in series in the second LED group G2 to emit light in reverse order (i.e., (L5→L4) based on the measured magnitude of the power and the LED driving power of the second LED group G2 if the measured magnitude of the power is smaller than or equal to the first threshold magnitude.

In the meantime, the second supply control unit 135 secondarily selects the LEDs whose light emission is to be controlled from the second LED group G2 in order based on a difference between the measured magnitude of the power and a sum of the magnitudes of the LED driving power of the first LED group and the magnitude of the driving power of LEDs constituting the second LED group G2 if the measured magnitude of the power is larger than or equal to the first threshold magnitude based on the comparison result of the comparison unit 131, and controls the supply of the power to the LEDs of the first LED group G1 and the primarily selected LEDs of the second LED group G2. In other words, the second supply control unit 135 controls the LEDs of the first LED group G1 to emit light sequentially in the serial connection order thereof if the measured magnitude of the power is larger than or equal to the first threshold magnitude, and controls a maximum number of LEDs connected in series in the second LED group G2 to emit light in order based on a difference between the measured magnitude of the power and a sum of the magnitudes of the LED driving power of the first LED group 및 the magnitude of the driving power of LEDs constituting the second LED group G2. Thus, the LEDs of the first LED group G1 and the second LED group G2 which are connected in series are controlled to emit light sequentially in order (i.e., L1→L2→L3→L4→5) if the measured magnitude of the power is larger than or equal to the first threshold magnitude.

Herein, the first threshold magnitude may be a sum of the magnitudes of the driving power of the LEDs constituting the first LED group.

Meanwhile, the number (n) of LEDs constituting the second LED group G2 is represented by the following equation 1:

$$n \le \left(\frac{t}{2}\right)_i \qquad \text{[Equation 1]}$$

wherein t is the number of a total of LEDs of the first LED group G1 and the second LED group G2, and (t/2)i is a round down integer of t/2. In other words, the first threshold magnitude can be set differently depending on the number of a total of LEDs constituting the LED unit 140. The first threshold magnitude is basically set to be equal to a sum of the magnitudes of the driving power of the LEDs included in the first LED group G1. Thus, if power smaller than or equal to the sum of the magnitudes of the driving power of the LEDs constituting the first LED group G1 is applied to the LED unit 140, the LEDs of the second LED group G2 are controlled to emit light sequentially in reverse order, by starting from the last LED of the second LED group G2. On the other hand, if power larger than the first threshold magnitude is applied to the LED unit 140, the LEDs of the first LED group G1 are controlled to emit light sequentially in order, by starting from the first LED of the first LED group G1.

Figure 4:
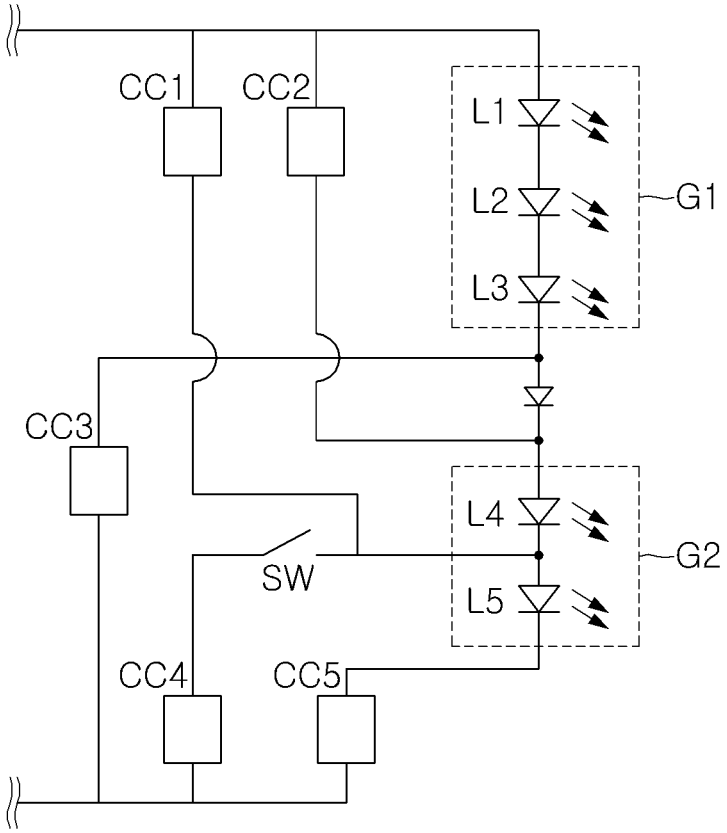
FIG. 4 is a circuit diagram illustrating one example of a light emission control unit in accordance with the present invention.
Figure 5:
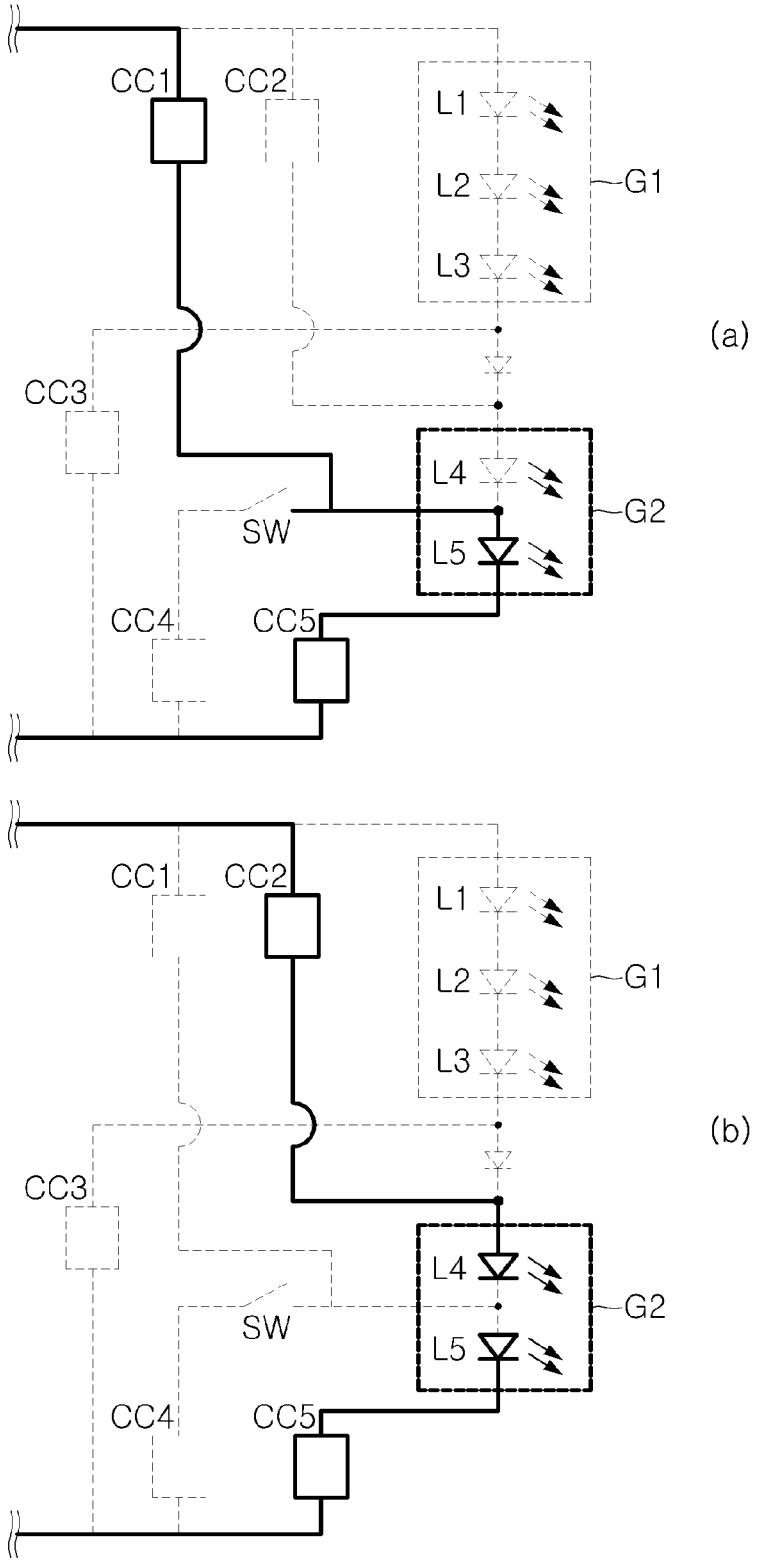
FIGS. 5 and 6 are circuit diagrams illustrating an example of the operational state of the light emission control unit shown in FIG. 4.
Figure 6:
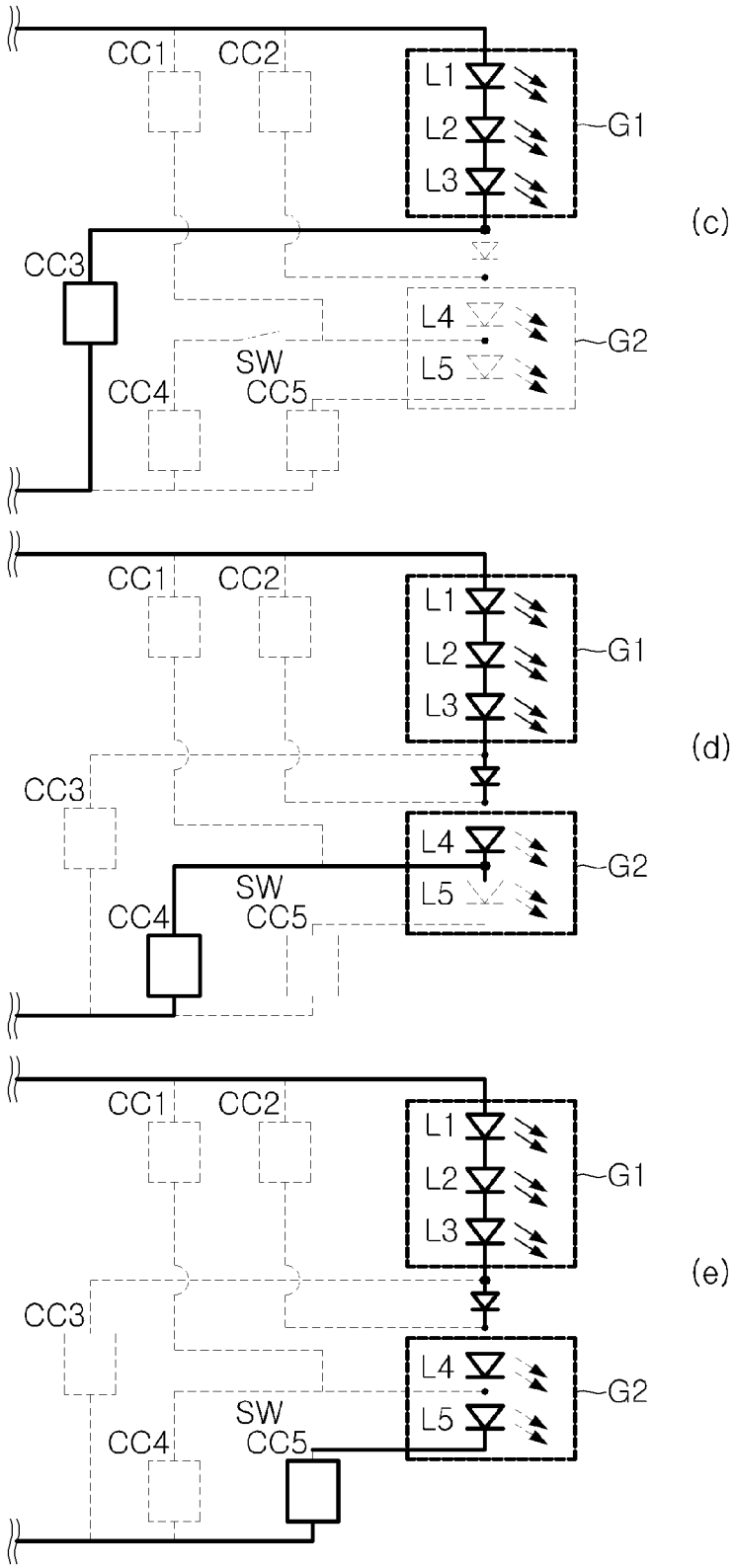

FIG. 4 is a circuit diagram illustrating one example of a light emission control unit in accordance with the present invention, and FIGS. 5 and 6 are circuit diagrams illustrating an example of the operational state of the light emission control unit shown in FIG. 4.

Referring to FIG. 4, the first LED group G1 and the second LED group G2 constituting the LED unit 140 are connected in series with each other. The first LED group G1 includes three LEDs L1, L2 and L3 that are connected in series, and the second LED group G2 includes two LEDs L4 and L5 that are connected in series with the last LED L3 of the first LED group G1. Herein, it is assumed that the LEDs constituting first LED group G1 and the second LED group G2 have the same operating voltage ($V_f$) as each other.

Referring to FIG. 5(*a*), the magnitude (V) of power applied to the LED unit 140 is smaller than or equal to the first threshold magnitude and is smaller than or equal to $2V_f$ (i.e., $V \le 2V_f$), a first control unit CC1 is controlled to be turned on so that current applied to the LED unit 140 flows to the last LED L5 of the second LED group G2 to cause the LED L5 of the second LED group G2 to emit light.

Referring to FIG. 5(*b*), if the magnitude of the power applied to the LED unit 140 increases over time and then the magnitude (V) of power applied to the LED unit 140 is smaller than or equal to the first threshold magnitude, and is larger than or equal to $2V_f$ and is smaller than or equal to $3V_f$ (i.e., $2V_f \le V \le 3V_f$), a second control unit CC2 is controlled to be turned on so that current applied to the LED unit 140 flows to the first LED L4 and the next LED L5 of the second LED group G2 to cause the LEDs L4 and L5 of the second LED group G2 to emit light.

In the meantime, referring to FIG. 6(*a*), if the magnitude of the power applied to the LED unit 140 increases over time and then the magnitude (V) of power applied to the LED unit 140 is larger than or equal to the first threshold magnitude, and is larger than or equal to $3V_f$ and is smaller than or equal to $4V_f$ (i.e., $3V_f \le V \le 4V_f$), a third control unit CC3 is controlled to be turned on so that current applied to the LED unit 140 flows to the LEDs L1, L2 and L3 to cause the LEDs positioned in the first LED group G1 to emit light sequentially in order. Referring to FIG. 6(*d*), if the magnitude of the power applied to the LED unit 140 increases over time and then the magnitude (V) of power applied to the LED unit 140 is larger than or equal to the first threshold magnitude, and is larger than or equal to $4V_f$ and is smaller than or equal to $5V_f$ (i.e., $4V_f \le V \le 5V_f$), a fourth control unit CC4 and a switch SW are controlled to be turned on so that current applied to the LED unit 140 flows to the LEDs L1, L2 and L3 positioned in the first LED group G1 and the LED L4 positioned in the second LED group G2 to cause the LEDs L1, L2, L3 and L4 to emit light sequentially in order. On the other hand, referring to FIG. 6(*e*), if the magnitude of the power applied to the LED unit 140 increases over time and then the magnitude (V) of power applied to the LED unit 140 is larger than or equal to the first threshold magnitude, and is larger than or equal to $5V_f$(i.e., $5 \leq V_f V$), a fifth control unit CC5 is controlled to be turned on so that current applied to the LED unit 140 flows to the LEDs L1, L2 and L3 positioned in the first LED group G1 and the LEDs L4 and L5 positioned in the second LED group G2 to cause the LEDs L1, L2, L3, L4 and L5 to emit light sequentially in order.

Figure 7:
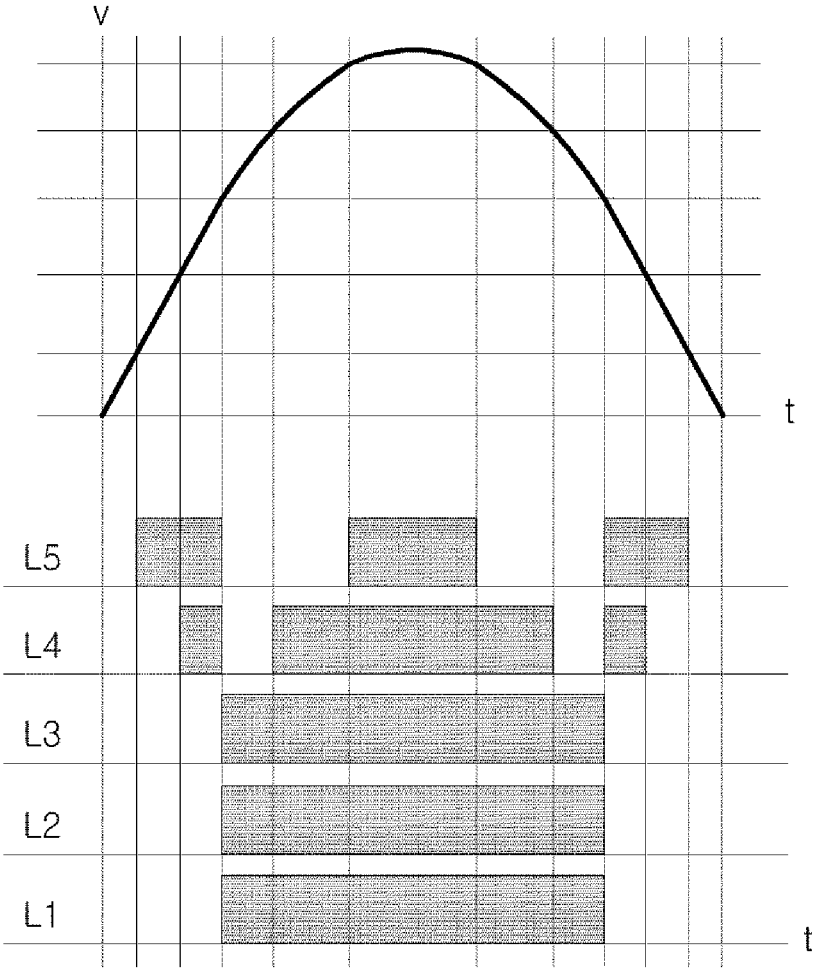
FIG. 7 is a diagrammatic view illustrating the light-emitting state of the LEDs of a first LED group G1 and a second LED group G2 constituting an LED unit depending on the operational state of the light emission control unit shown in FIGS. 5 and 6.

FIG. 7 is a diagrammatic view illustrating the light-emitting state of the LEDs of a first LED group G1 and a second LED group G2 constituting an LED unit depending on the operational state of the light emission control unit shown in FIGS. 5 and 6.

Referring to FIG. 7, more specifically, as the magnitude of the power applied to the LED unit 140 increases over time, the LEDs of the second LED group G2 is driven to emit light in reverse order (i.e., L5→L4) by starting from the last LED L5 of the second LED group G2. If the magnitude of power applied to the LED unit 140 exceeds the first threshold magnitude over time, the LEDs of the first LED group and the second LED group are driven to emit light sequentially in order (L1→L2→L3→L4→L5) by starting from the first LED L1 of the first LED group.

Figure 8:
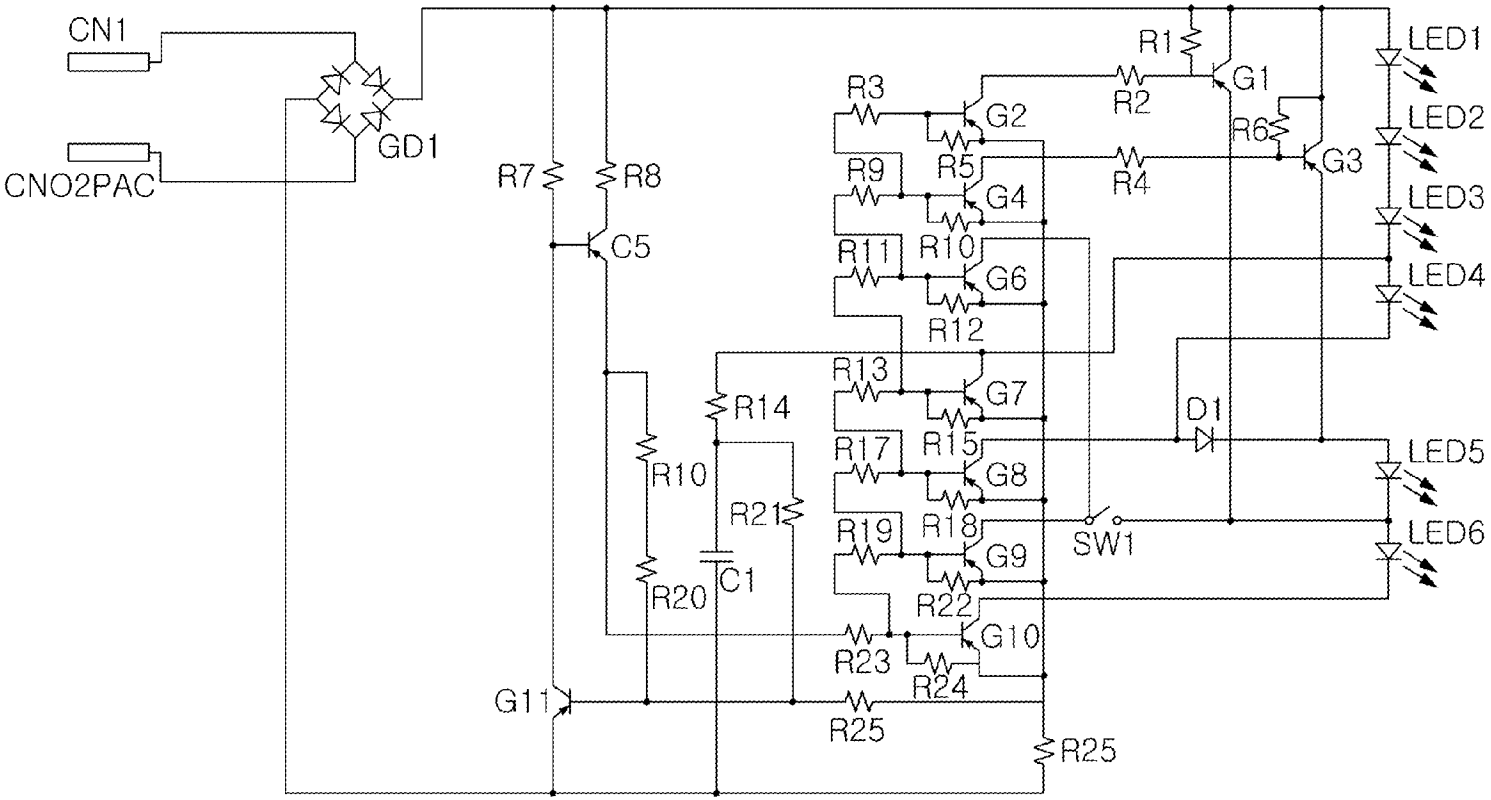
FIG. 8 is a circuit diagram illustrating an example of a circuit of the LED driving device in accordance with the present invention.

FIG. 8 is a circuit diagram illustrating an example of a circuit of the LED driving device in accordance with the present invention.

As one example, the light emission control unit and the LED driving device of FIGS. 4 and 8 can be modified in design in various manners to control the driving order of the LEDs constituting the LED unit sequentially in reverse order or in order depending on the magnitude of the power applied to the LED unit, which falls within the scope of the present invention.

Figure 9:
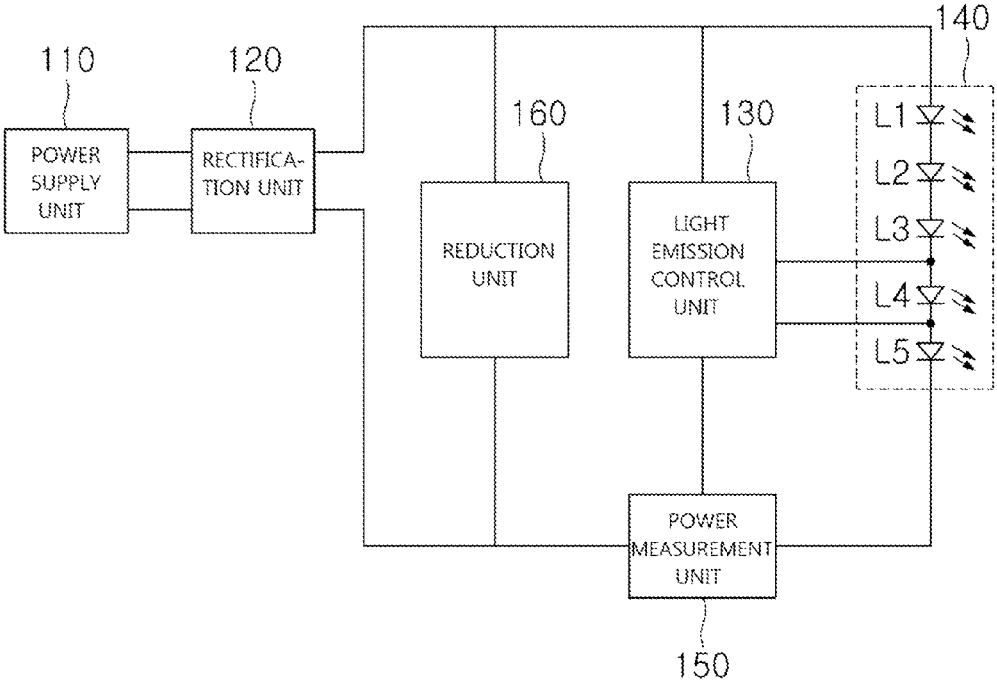
FIG. 9 is a block diagram illustrating an LED driving device in accordance with another embodiment of the present invention.

FIG. 9 is a block diagram illustrating an LED driving device in accordance with another embodiment of the present invention; and Referring to FIG. 9, more specifically, in the same manner as described above with reference to FIG. 3, a power supply unit 110 supplies commercial AC power, and a rectification unit 120 rectifies the commercial AC power applied thereto from the power supply unit 110 into DC power. An LED unit 140 includes a first LED group G1 including one or more LEDs connected in series with each other and a second LED group G1 including one or more LEDs connected in series with each other. The LED unit 140 emits light using the power supplied thereto from the rectification unit 120.

A power measurement unit 150 measures the magnitude of the power supplied from the rectification unit 120 to the LED unit 140. The light emission control unit 130 controls the light-emitting order of the LEDs of the LED unit 140 so that the LEDs of the second LED group G2 emit light sequentially in reverse order, by starting from the last LED of the second LED group G2, or the LEDs of the first LED group G1 and the second LED group G2 emit light sequentially in order, by starting from the first LED of the first LED group G1, based on the measured magnitude of the power.

A reduction unit 160 is connected in parallel with the rectification unit 120 and the LED unit 140. The power rectified by the rectification unit 120 and applied to the LED unit 140 has a magnitude that does not allow any LED of the LEDs of the LED unit 140 to be driven at a two-fold frequency, thus causing instantaneous flickering to occur. The reduction unit 160 charges the power applied to the LED unit 140, and then discharges the charged power if the magnitude of the power applied from the rectification unit 120 to the LED unit 140 is smaller than the magnitude of the power charged in the reduction unit 160 to temporarily maintain the magnitude of the power applied to the LED unit 140 so that flickering of the LED lighting is prevented from occurring.

Figure 10:
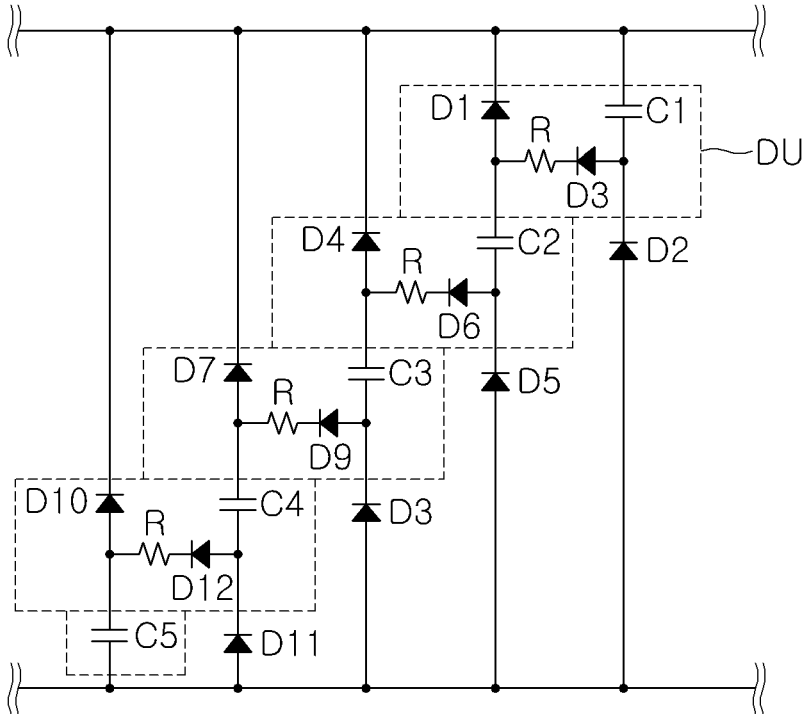
FIG. 10 is a circuit diagram illustrating one example of a reduction unit in accordance with the present invention.

FIG. 10 is a circuit diagram illustrating one example of a reduction unit in accordance with the present invention.

Referring to FIG. 10, the reduction unit 160 may include a plurality of unit reduction units DU that are connected in series with each other. The unit reduction unit DU includes low-capacity capacitors C1, C2, C3, C4 and C5. The number of the unit reduction units DU may be set such that the number of stages of the unit reduction units are made different depending on the technical field to which the present invention is applied or the number of LEDs constituting the LED unit 140 or the operating voltage of the LEDs. As the number of the stages of the unit reduction units DU constituting the reduction unit 160 is increased, the magnitude of the power charged in each capacitor becomes low and the capacities of the capacitors can be designed to be low.

While the present invention has been described in connection with the exemplary embodiments illustrated in the drawings, they are merely illustrative and the invention is not limited to these embodiments. It will be appreciated by a person having an ordinary skill in the art that various equivalent modifications and variations of the embodiments can be made without departing from the spirit and scope of the present invention. Therefore, the true technical scope of the present invention should be defined by the technical sprit of the appended claims.

The invention claimed is:

1. An LED driving device comprising:

a power supply unit for rectifying AC power and supplying the rectified power;

an LED unit for emitting light using the power supplied thereto from the power supply unit, the LED unit including a first LED group and a second LED group, each LED group including one or more LEDs connected in series with each other;

a power measurement unit for measuring the magnitude of the power supplied from the power supply unit to the LED unit; and a light emission control unit for controlling the light-emitting order of the LEDs of the LED unit so that the LEDs of the second LED group emit light sequentially in reverse order or the first LED group and the second LED group emit light sequentially in order based on the measured magnitude of the power, wherein the first LED group and the second LED group are connected in series with each other, wherein the light emission control unit controls the LEDs of the second LED group to emit light sequentially in reverse order, by starting from the last LED of the second LED group if the measured magnitude of the power is smaller than or equal to a first threshold magnitude, and controls the LEDs of the first LED group and the second LED group to emit light sequentially in order, by starting from the first LED of the first LED group if the measured magnitude of the power is larger than or equal to the first threshold magnitude.

2. The LED driving device according to claim 1, wherein the first threshold magnitude is a sum of the magnitudes of the driving power of the LEDs constituting the first LED group.

3. The LED driving device according to claim 2, wherein the number (n) of LEDs constituting the second LED group is represented by the following equation 1:

$$n \leq \left(\frac{t}{2}\right)_i \quad \text{[Equation 1]}$$

wherein t is the number of a total of LEDs of the first LED group and the second LED group, and (t/2)i is a round down integer of t/2.

4. The LED driving device according to claim 3, wherein the power measurement unit measures the magnitude of current or voltage supplied to the LED unit, and determines the magnitude of power supplied to the LED unit based on the measured current or voltage.

5. The LED driving device according to claim 3, wherein the power measurement unit measures the phase of the power supplied to the LED unit, and determines the magnitude of power supplied to the LED unit based on the measured phase.

6. The LED driving device according to claim 2, wherein the light emission control unit comprises:

a comparison unit for comparing the measured magnitude of the power with the first threshold magnitude;

a first supply control unit for primarily selecting the LEDs whose light emission is to be controlled from the second LED group in reverse order based on the magnitude of the driving power of the LEDs constituting the second LED group and the measured magnitude of the power if the measured magnitude of the power is smaller than or equal to the first threshold magnitude based on the comparison result of the comparison unit, and controlling the supply of the power to the primarily selected LEDs of the second LED group; and a second supply control unit for secondarily selecting the LEDs whose light emission is to be controlled from the second LED group in order based on a difference between the measured magnitude of the power and a sum of the magnitudes of the LED driving power of the first LED group and the magnitude of the driving power of LEDs constituting the second LED group if the measured magnitude of the power is larger than or equal to the first threshold magnitude based on the comparison result of the comparison unit, and controlling the supply of the power to the LEDs of the first LED group and the primarily selected LEDs of the second LED group.

7. The LED driving device according to claim 6, further comprising a reduction unit connected in parallel with the rectification unit and the LED unit so as to charge the power applied from the power supply unit to the LED unit, and maintain the magnitude of the power supplied from the power supply unit to the LED unit if the magnitude of the power supplied from the power supply unit to the LED unit is smaller than the magnitude of the power charged in the reduction unit.

8. The LED driving device according to claim 7, wherein the reduction unit comprises a plurality of unit reduction units DU that are connected in series with each other, and wherein the unit reduction unit comprises a condenser for charging the power supplied from the power supply unit to the LED unit.

9. The LED driving device according to claim 8, wherein the power measurement unit measures the magnitude of current or voltage supplied to the LED unit, and determines the magnitude of power supplied to the LED unit based on the measured current or voltage.

10. The LED driving device according to claim 7, wherein the power measurement unit measures the magnitude of current or voltage supplied to the LED unit, and determines the magnitude of power supplied to the LED unit based on the measured current or voltage.

11. The LED driving device according to claim 7, wherein the power measurement unit measures the phase of the power supplied to the LED unit, and determines the magnitude of power supplied to the LED unit based on the measured phase.

12. The LED driving device according to claim 6, wherein the power measurement unit measures the magnitude of current or voltage supplied to the LED unit, and determines the magnitude of power supplied to the LED unit based on the measured current or voltage.

13. The LED driving device according to claim 6, wherein the power measurement unit measures the phase of the power supplied to the LED unit, and determines the magnitude of power supplied to the LED unit based on the measured phase.

14. The LED driving device according to claim 2, wherein the power measurement unit measures the magnitude of current or voltage supplied to the LED unit, and determines the magnitude of power supplied to the LED unit based on the measured current or voltage.

15. The LED driving device according to claim 2, wherein the power measurement unit measures the phase of the power supplied to the LED unit, and determines the magnitude of power supplied to the LED unit based on the measured phase.

16. The LED driving device according to claim 1, wherein the power measurement unit measures the magnitude of current or voltage supplied to the LED unit, and determines the magnitude of power supplied to the LED unit based on the measured current or voltage.

17. The LED driving device according to claim 1, wherein the power measurement unit measures the phase of the power supplied to the LED unit, and determines the magnitude of power supplied to the LED unit based on the measured phase.

* * * * *